US005337444A

United States Patent [19]

Young et al.

[11] Patent Number: 5,337,444

[45] Date of Patent: Aug. 16, 1994

[54] SURFACE SWEEPING MACHINE WITH OVER-THE-CAB HOPPER DUMPING

[75] Inventors: Gary B. Young, Waco; Albert L. Hanel, Eddy; Kenneth R. Veselka, Axtell, all of Tex.

[73] Assignee: Tymco, Inc., Waco, Tex.

[21] Appl. No.: 957,880

[22] Filed: Oct. 7, 1992

Related U.S. Application Data

[62] Division of Ser. No. 769,419, Oct. 1, 1991, Pat. No. 5,173,989, which is a division of Ser. No. 188,521, Apr. 29, 1988, Pat. No. 5,072,485.

[51] Int. Cl.[5] ..... E01H 1/08

[52] U.S. Cl. ..... 15/352; 55/429; 55/493

[58] Field of Search ..... 15/347, 352; 55/429, 55/493; 298/23 C, 23 MD

[56] References Cited

U.S. PATENT DOCUMENTS 3,304,572 2/1967 Wendel ..... 15/352 X
3,744,653 7/1973 Jensen ..... 15/347 X
3,824,771 7/1974 Williams ..... 55/429
4,219,901 9/1980 Burgoon et al. ..... 15/352
4,708,723 11/1987 Howeth ..... 55/429 X

FOREIGN PATENT DOCUMENTS 3-146109 6/1991 Japan ..... 15/347

*Primary Examiner*—Michael S. Huppert
*Assistant Examiner*—Janice Krizek
*Attorney, Agent, or Firm*—Diller, Ramik & Wight

[57] ABSTRACT

A road sweeper which includes a hopper between a cab and a centrifugal separator, a pair of relatively telescopically extendable and retractable members, one member of each pair being pivoted to a frame of the vehicle and another member of each pair being pivoted to a hopper, a pair of control arms pivoted one each between one of the extendable members and the vehicle, and a tilt cylinder and occupant-protecting mechanism cooperatively operative such that upon relative extension of the extendable and retractable members the control arms effect compound motion of the hopper to a position over-the-cab for subsequent dumping and the automatic interpositioning of the occupant protection mechanism between the hopper and the cab.

7 Claims, 13 Drawing Sheets

SURFACE SWEEPING MACHINE WITH OVER-THE-CAB HOPPER DUMPING

This application is a divisional application of Ser. No. 07/769,419, filed Oct. 1, 1991, now U.S. Pat. No. 5,173,989, which is a divisional application of Ser. No. 07/188,521, filed Apr. 29, 1988, now U.S. Pat. No. 5,072,485.

BACKGROUND OF THE INVENTION

The present invention is directed to a surface sweeping machine, commonly referred to as a road sweeper, which utilizes gutter brushes and a pick-up head for delivering air-entrained debris into a hopper. The heavier debris falls to the bottom of the hopper and lighter dust enters a centrifugal separator which separates the dust from the air, delivers the dust to the hopper, and the cleaner air is recirculated along a generally continuous path of travel to the pick-up head and back to the hopper.

Typical road sweepers or street sweepers of the type aforesaid are disclosed in commonly assigned U.S. Pat. Nos. 3,512,206; 3,545,181; 3,790,981 and 4,660,248 issued respectively on Aug. 30, 1966; Aug. 30, 1966; Feb. 12, 1974 and Apr. 28, 1987. The totality of the disclosures of the latter-identified patents are incorporated hereat by reference, particularly in regard to details of construction, including, but not limited to, the gutter brushes, the pick-up head, the centrifugal separator, etc.

The street sweeper of U.S. Pat. Nos. 3,512,206 and 3,545,181 is quite typical in its construction and includes a conventional vehicle or truck having a frame, a cab, an auxiliary engine behind the cab for driving a turbine of the centrifugal separator, a continuous closed path air circulating system, and a hopper at the rear end of the frame having an outlet normally closed by a door. When the hopper is filled with debris, the street sweeper is driven to a dump site, the hopper door is then opened to discharge the debris, and the hopper is tilted or pivoted to augment the discharge of the debris through the now opened hopper door. Such conventional rear-dumping hoppers are well known but have obvious draw-backs, particularly associated with rearward visibility as, for example, when the street sweeper is backed into the dump site area.

Disadvantages of such rear-dumping vehicles are acknowledged and set forth in U.S. Pat. Nos. 4,236,756; 4,171,551; 4,178,647; 4,222,141and 4,343,060 issued respectively on Dec. 2, 1980; Oct. 23, 1979; Dec. 18, 1979; Sep. 16, 1980 and Aug. 10, 1982 in the names of Donald L. Hildebrand et al., particularly with respect to the disadvantages of rearward visibility and the acknowledged advantages of forward visibility associated with forward dumping, high dumping or over-the-cab dumping of hoppers associated with street sweepers. The subject matter of the latter patents was commercially manufactured by the common assignee for several years, but is no longer being manufactured thereby. However, high dump or forward-dumping of street sweeper hoppers remains viable, particularly when, as in the present case, it is intended that the hopper be dumped into a dump truck or like vehicle. Thus, with the high dump street sweeper of the present invention it is unnecessary to back the street sweeper toward the vehicle into which the debris of the hopper is to be dumped, and instead the street sweeper is simply driven adjacent the dump truck and the debris from the street sweeper hopper is dumped forwardly over-the-cab with the attendant desirable forward visibility heretofore noted.

SUMMARY OF THE INVENTION

In keeping with the present invention, a novel surface sweeping machine with an over-the-cab dumping hopper is provided and includes a conventional vehicle frame and its associated engine, cab, wheels, etc. The cab is located at a forward end portion of the frame and a conventional centrifugal separator, as disclosed in U.S. Pat. Nos. 3,545,181 and 3,512,206 is located at a rear end portion of the frame. The centrifugal separator is part of a continuous recirculating closed path of travel for air which includes a pick-up head transversely spanning the vehicle frame. Air-entrained debris exits the pick-up head and enters an associated hopper which in a first position is located between the cab and the centrifugal separator. Heavier debris accumulates in the hopper while lighter debris and dust entrained in the air exits the hopper and enters the centrifugal separator. The centrifugal separator separates the lighter debris and the dust, discharges the latter into the hopper, and the cleaner air exits the centrifugal separator and is delivered to an inlet of the pick-up head for continuous circulation.

Two pairs of relatively extendable and retractable first and second members are carried by the vehicle in generally parallel relationship to each other. A first of the members of each pair is pivotally connected to the hopper and an opposite end of the second member of each pair is pivotally connected to the frame. A rigid control arm is articulately connected to each first member, and is also pivotally connected to the frame. Associated hydraulic cylinders are operative through an appropriate hydraulic circuit to selectively extend and retract the first and second members of both pairs such that the hopper is moved from its first position behind the cab and adjacent the centrifugal separator along a compound path of travel which proceeds forwardly and upwardly as the control arms pivot and the first and second members extend until the hopper reaches a second position generally overlying the cab. Thereafter an associated hopper door is opened and the hopper is tilted to effect over-the-cab dumping. The return cycle is initiated by the hopper tilting back to its original position followed by the closing of the hopper dump door. Thereafter, retraction of the first and second members results in the hopper returning along the same compound path of travel, but in the opposite direction, from the second or dumping position to the first or travel position adjacent the centrifugal separator.

A dumping cylinder is also pivotally connected to the frame and to the hopper to guide the hopper over the cab and additionally provide pivotal dumping movement to the hopper only after the hopper is in a pre-dumping position thereof.

A major safety feature of the over-the-cab dumping road sweeper is the provision of an occupant protection system which assures that the hopper can not descend from its second/dumping position accidentally or inadvertently due to mechanical or hydraulic failure and, thus, there is avoided damage to the cab and/or injury to any occupant therein. The occupant protection system includes two pair of links with the links of each pair pivotally connected to each other. One of the links of each pair is also pivoted to one of the extendable and retractable members which in the extended position projects over the cab, and the other link of each pair is pivotally connected to the sweeper frame adjacent and to the rear of the cab. When the hopper rests upon the frame in its first position, the two pairs of links are folded compactly in an area between the hopper and the cab, but as the hopper is moved along the compound path of travel towards its dumping position, the two links of each pair progressively pivot relative to each other until a first link of each pair is positioned between the cab and the hopper when the hopper is in its second or dumping position. If the hopper should, for any reason, tend to move toward the cab, as, for example, due to failure of the dumping cylinder or the hydraulics associated therewith, the hopper would contact these first links and the latter would prevent the hopper from continuing toward and into potentially damaging contact with the vehicle cab and any occupants therein.

The novel over-the-cab dumping sweeper also includes a novel hopper which includes a flexible deflector above an inlet pipe which is automatically flexed or deflected by high speed inlet air. In addition, the flexible deflection is also automatically flexed when the hopper door is opened during a dumping cycle to remove debris which may have accumulated upon the deflector during a sweeping cycle. The novel hopper also includes a cleaning chamber defined between an outermost wall of the hopper door and a screen inboard thereof into which water from a nozzle can be directed through forward/downward facing openings when the hopper is in its second/dumping position, and the dumping door is opened to remove debris from the underside of the screen and/or the interior of the chamber.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
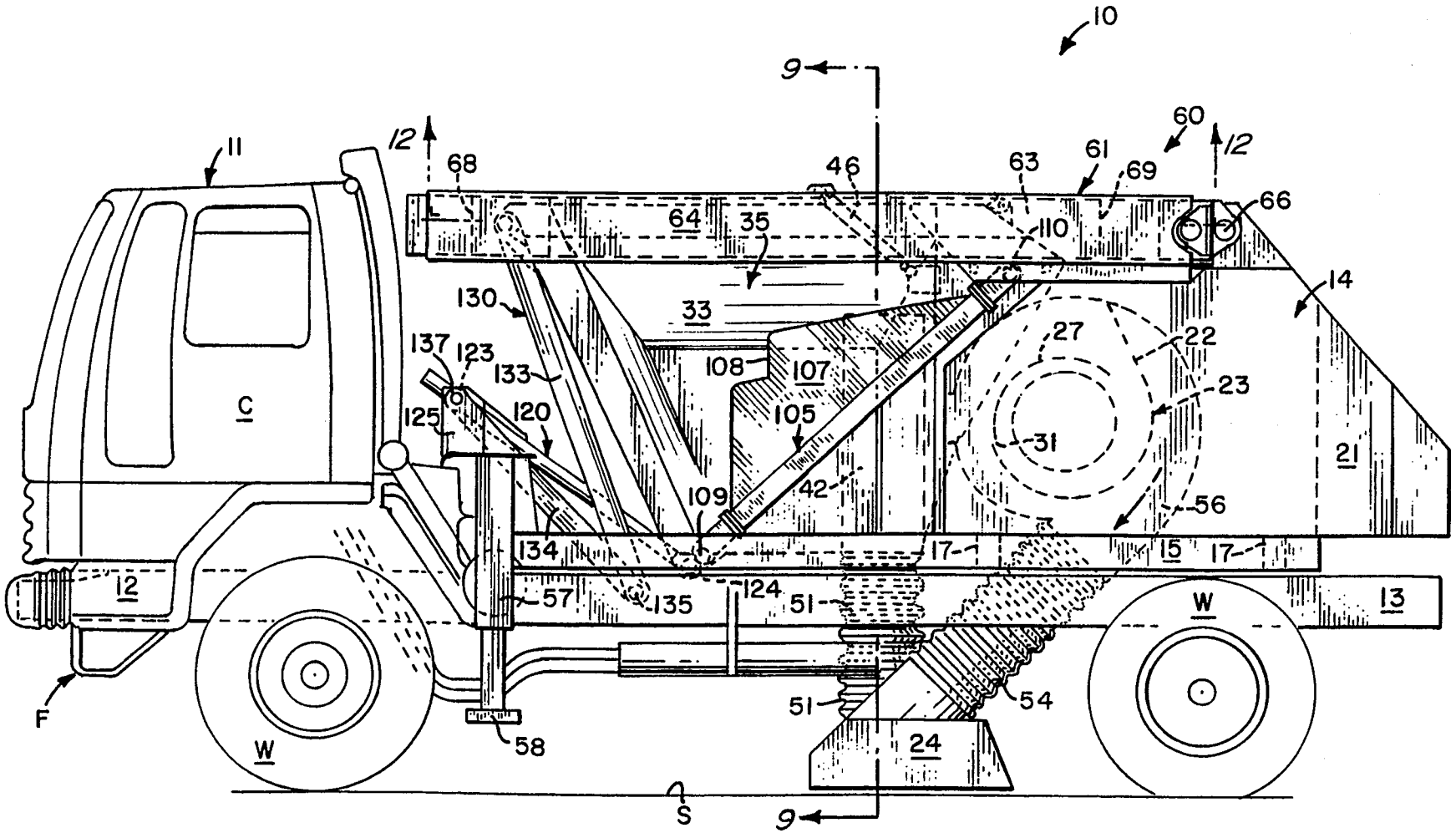
FIG. 1 is a schematic side elevational view of the over-the-cab hopper dumping street sweeper of this invention, and illustrates a hopper located between a cab of the vehicle and a centrifigal separator, one of a pair of relatively extendable and retractable first and second members pivotally connected to the hopper and to the vehicle frame, a control arm pivoted to the frame and one of the members, a hopper dumping cylinder pivotally connected between the hopper and the frame, and a pair of pivotally connected links defining an occupant-protecting system.
Figure 2:
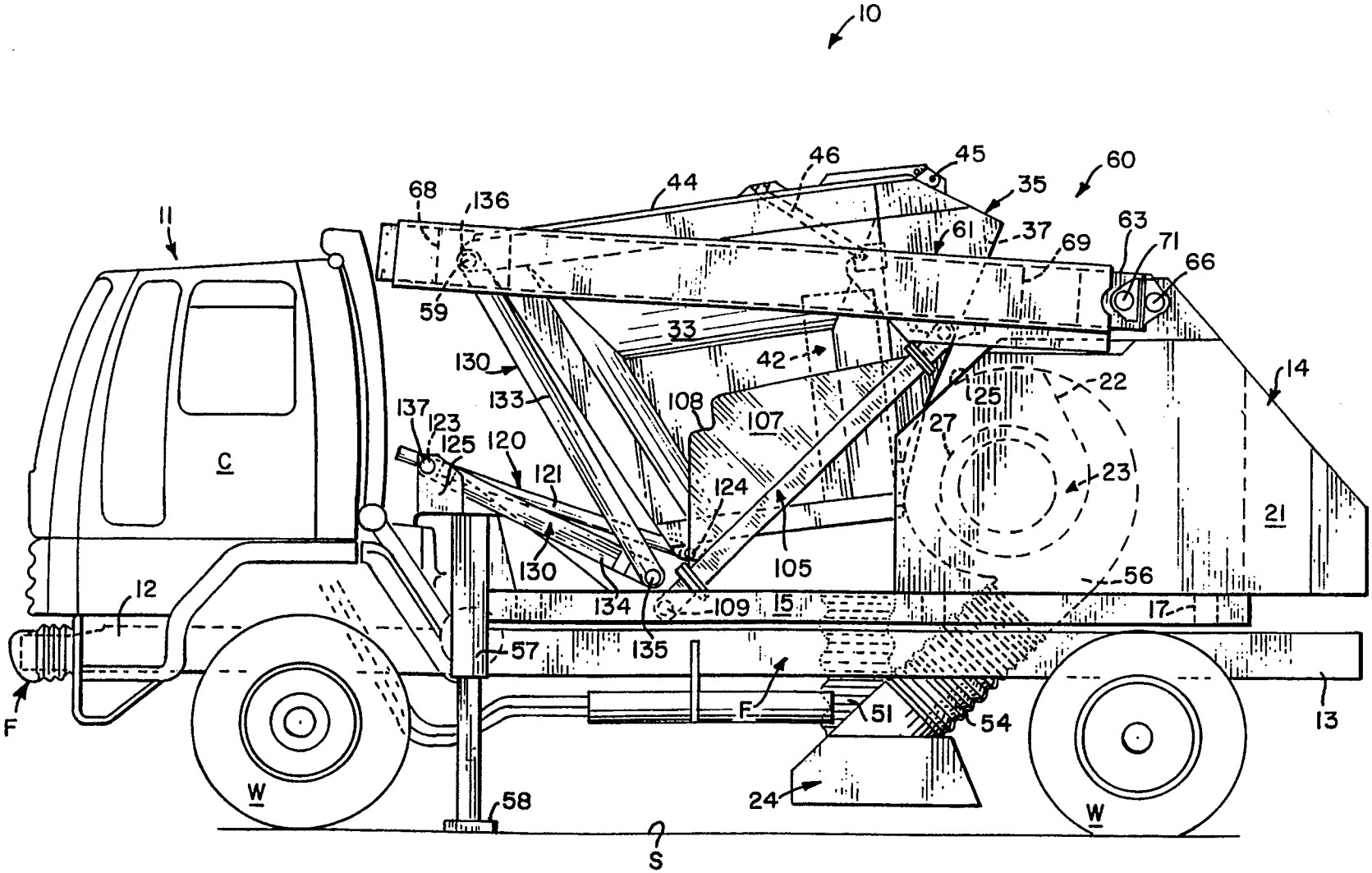
FIG. 2 is a schematic side elevational view of the street or road sweeper of FIG. 1, and illustrates relative positions of the various components during initial movement of the hopper from its nondumping or travel position of FIG. 1 toward its dumping position of FIG. 8.
Figure 3:
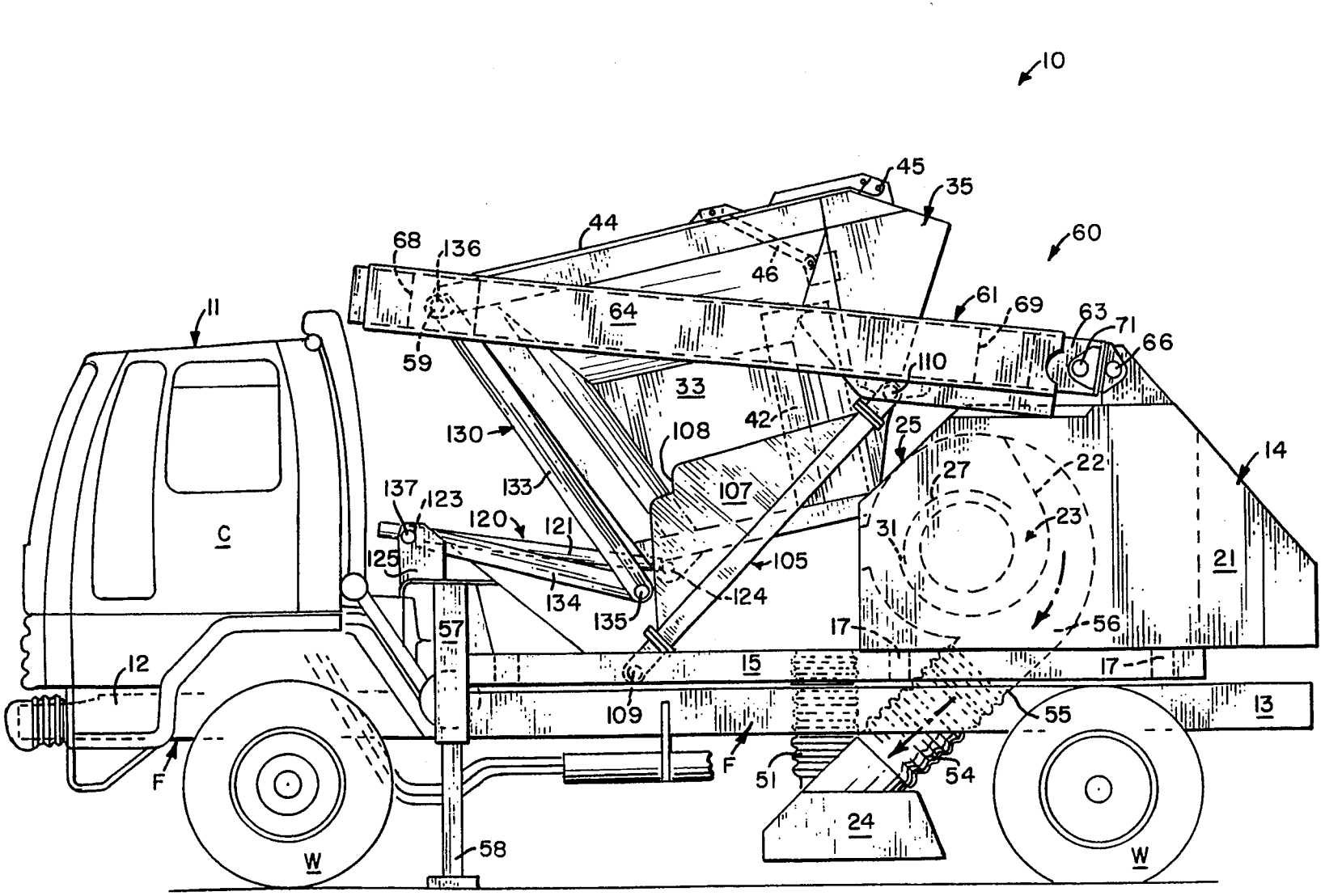
FIGS. 3 through 7 are schematic side elevational views of the street sweeper, and illustrate the progressive relative movement and positions of the various components to move the hopper from its first or nondumping position of FIG. 1 generally along a compound path of travel moving from right-to-left and upwardly along the longitudinal axis of the vehicle until reaching the over-the-cab or pre-dumping position of FIG. 7 with one of the links of each pair of links of the occupant protection system being protectively disposed between the hopper and the cab.
Figure 4:
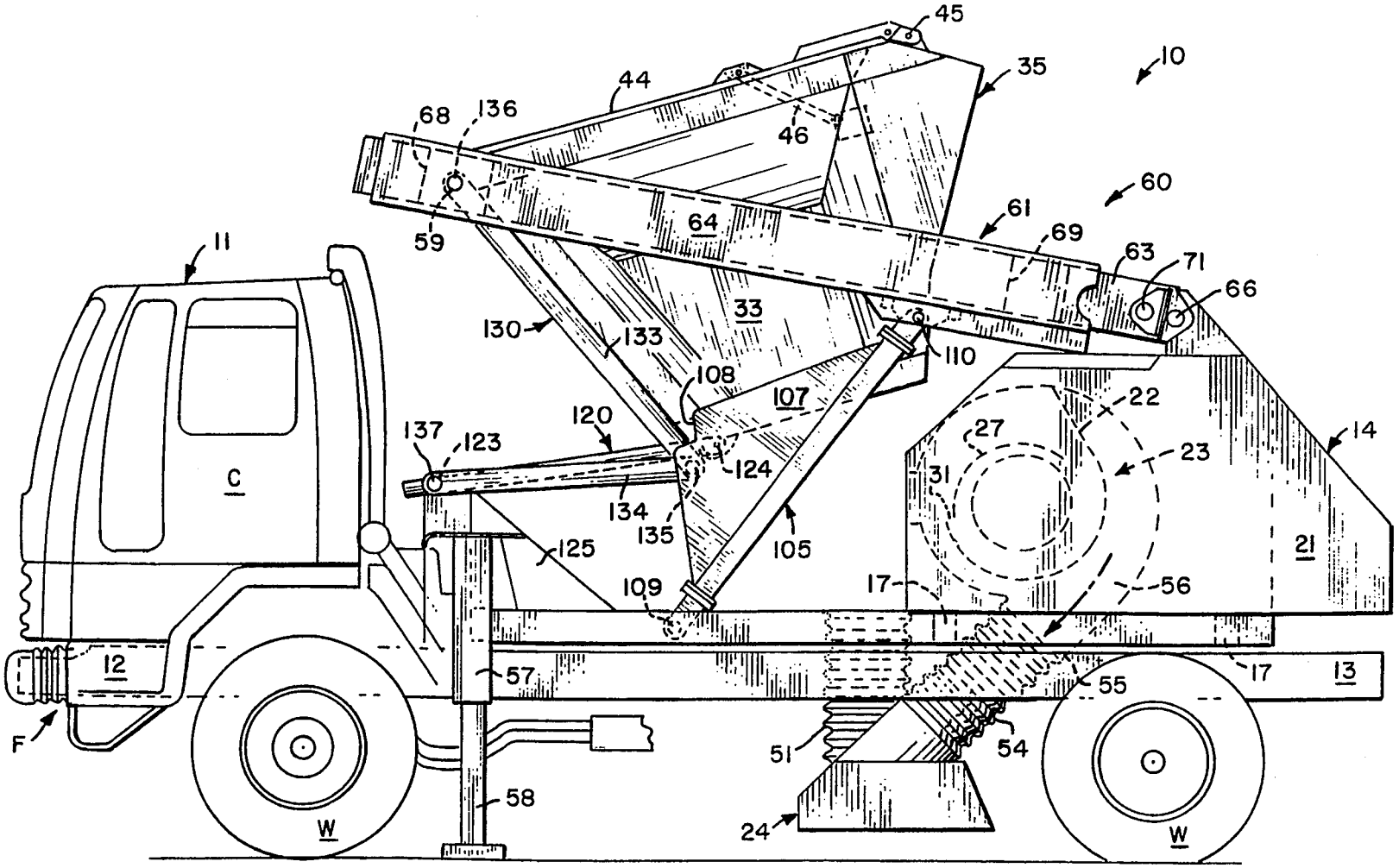
Figure 5:
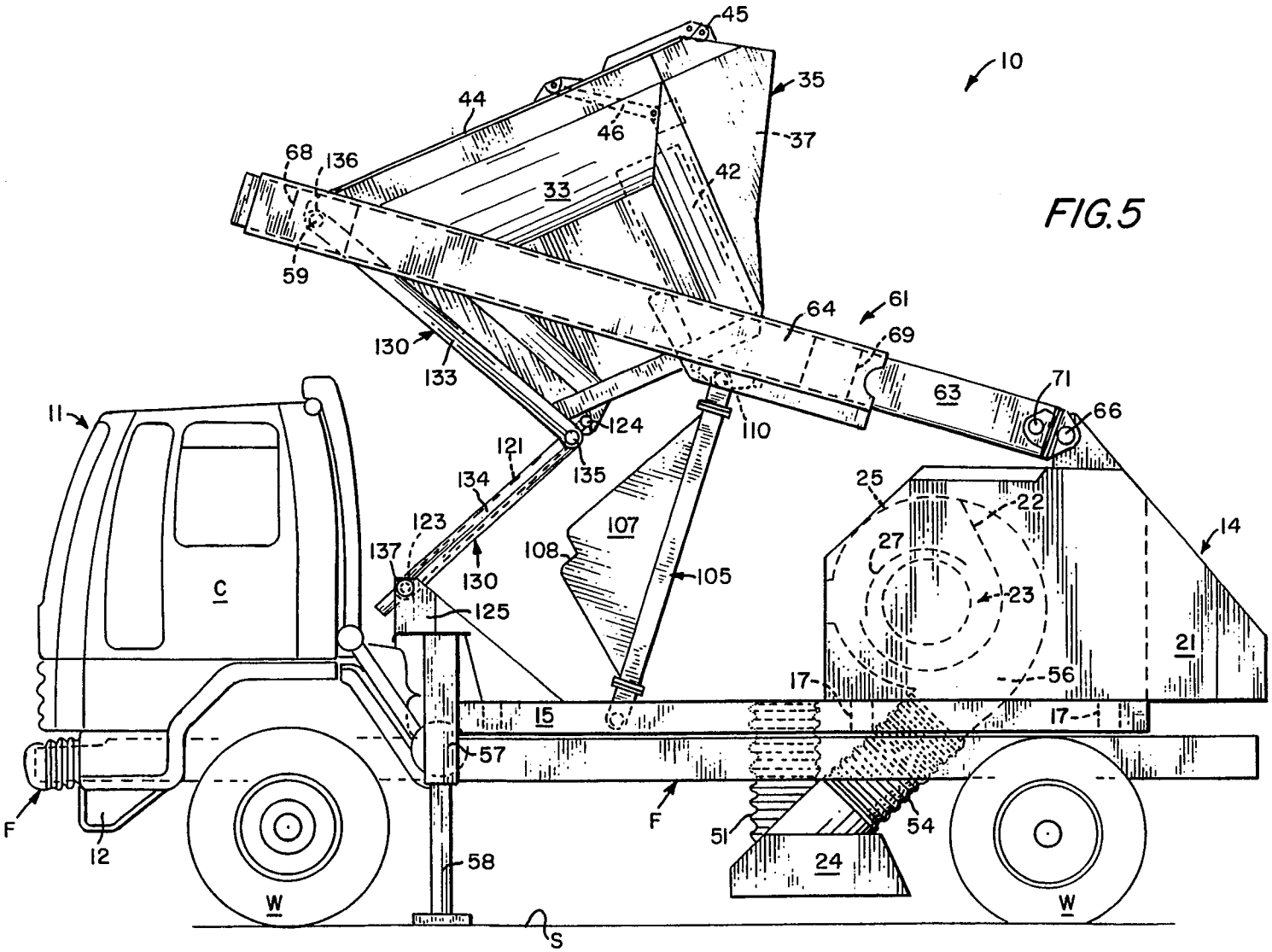

A novel high-dump or over-the-cab road sweeper, street sweeper or sweeping machine is generally designated by the reference numeral 10 and includes a conventional vehicle 11 having a frame F, an occupant cab C at a front end or front end portion 12 of the frame F, a rear end or rear end portion 13, and wheels W appropriately conventionally suspended from the frame F. The vehicle 11 includes an engine (not shown), transmission (also not shown) etc., all provided by the manufacturer which may be, for example, Ford Motor Company, General Motors Corporation, or the like.

A sweeper frame 14 (FIGS. 1 through 10) is rigidly secured to the vehicle frame F and includes generally parallel spaced apart side frame members 15, 16 (FIGS. 1 through 11) and a plurality of transverse cross-frame members 17 connected therebetween. A pair of upstanding generally parallel spaced side walls 20, 21 (FIG. 11) are secured to the frame members 16, 15, respectively, and situated therebetween is a housing 22 of conventional centrifugal separator means 23 (FIG. 13) in the form of a centrifugal separator of the type disclosed in U.S. Pat. Nos. 3,545,181; 3,512,206 and 4,660,248 having a blower 19 including a turbine (not shown) driven by a conventional auxiliary engine (not shown) supported upon the sweeper frame 14 rearward of the housing 22. In addition to separating dust from debris-entrained air, the centrifugal separator 23 also establishes a continuous closed path of travel for air into, along and out of a conventional pick-up head 24 of the type disclosed in the latter-noted patents. The housing 22 of the centrifugal separator 23 includes a generally rectangular inlet opening 25 which carries a seal 26. A generally curved or arcuate inlet plate 27 (FIGS. 1 and 13) extends across the rectangular inlet opening 25 and separates the opening 25 into an upper inlet opening 30 and a lower dust discharge opening 31 which will be described more fully hereinafter.

A hopper 35 is illustrated in FIG. 1 in its nondumping, travel or first position. The hopper 35 is generally a hollow receptacle defined by a bottom wall 29 (FIGS. 9 and 10), side walls 32, 33, a front or forward wall 34 and a rear wall 36 which includes therein a generally rectangular outlet opening 37 (FIG. 1C) which corresponds in size and shape to the rectangular opening 25 (FIG. 11) of the centrifugal separator housing 22. With the hopper 35 in its nondumping or travel position (FIG. 1) a rectangular peripheral edge portion 40 (FIG. 10) immediately adjacent the opening 37 rests against and forms a hermetic seal with the seal 26 (FIG. 11) of the centrifugal separator housing 22. A plane Ps (FIG. 13) defines an angle of approximately 60° with the horizontal and defines the plane of scaling between the rectangular peripheral portion 40 (FIG. 10) of the hopper rear wall 36 and the seal 26 (FIGS. 11 and 13) of the centrifugal separator housing 22. An opening 41 (FIGS. 10 and 13) is formed in the bottom wall 29 of the hopper 35 and rising therefrom interiorly of the hopper 35 is an inlet tube 42 having an uppermost inlet opening 43 spaced below a hopper door 44 (FIGS. 2–8) which is pivoted at 45. The door 44 can be opened and closed selectively by fluid cylinders 46 at opposite sides thereof which are pivotally connected to the door 44 and to each of the side walls 32, 33. A flexible deflector 47 is connected to the inlet tube 42 adjacent the inlet opening 43 thereof, and as air-entrained debris flows upwardly in the tube 42, it is directed forwardly and generally downwardly by the flexible deflector 47. Heavier debris D will drop to and accumulate upon the bottom wall 29 of the hopper 35, while air-entrained dust will be drawn through rectangular screens 28, 75 through the hopper outlet 37 and into the inlet opening 30 of the housing 22 into the centrifugal separator 23 as is indicated by the unnumbered headed arrows shown in FIG. 13. The screen 75 is carried by the door 44 in spaced relationship to a top panel 79. A front wall 76 spans the distance between the wall 79 and the screen 75 and has a plurality of openings 77 which run the length of the wall 76 between opposite side walls 78 depending downwardly from the top panel 79. In this manner the top panel 79, the screen 75, the front wall 76 and the two depending side walls or panels 78 define a chamber 80 of the door 44. Some of the heavier debris D will strike the underside and adhere to the screen 75 and other debris may lodge in the chamber 80. However, due to the holes or openings 77, when the door 44 is opened, a high velocity stream of water from a hose can be directed into the chamber 80 through the opening 77 to cleanse the chamber 80 of any debris and, as the water impinges against the screen 75 from the chamber side, any debris on the inside of the screen 75 will be flushed/rinsed therefrom.

A flexible link 50 is connected between the flexible deflector 47 and the screen 75 of the door 44 of the hopper 35. When the street sweeper 10 is cleaning debris from the surface S through the pick-up head 24 (FIG. 1) the high speed air exiting the inlet tube 42 automatically vibrates or flexes the deflector 47 to shake any debris D tending to adhere thereto. Additionally, as will be apparent more fully hereinafter, when the hopper door 44 is opened (FIG. 8) by the fluid cylinders 46, the link 50 will flex, deflect or shake the flexible deflector 47 and thereby rid it of any debris which may have accumulated thereupon. This results in self-cleaning of the flexible deflector 47 of accumulated debris each time the hopper door 44 is opened and closed during a dumping cycle.

The hopper opening 41 in the bottom wall 29 forms a seal with a like opening of a flexible conduit or pipe 51 (FIGS. 9 and 13) which is in turn connected to an outlet opening 52 of the pick-up head 24. An inlet opening unnumbered of the pick-up head 24 is connected to a like flexible conduit or tube 54 which is in turn connected by a fitting unnumbered to the blower housing outlet by an outlet 56 of the blower 19.

Figure 13:
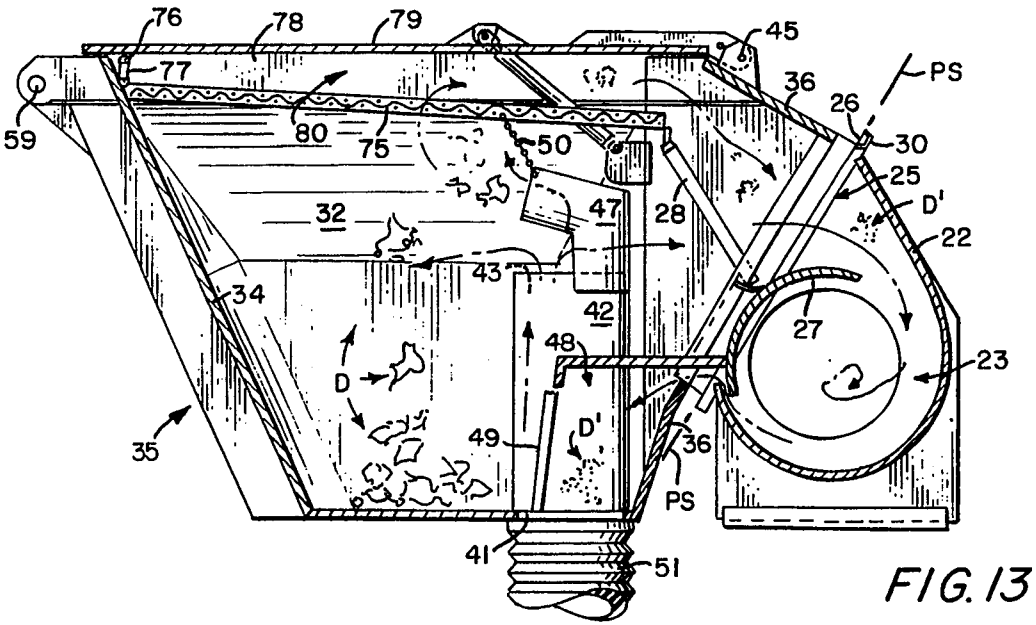
FIG. 13 is a longitudinal sectional view taken through the hopper and the centrifugal separator, and particularly illustrates the manner in which air-entrained dust enters the centrifugal separator and dust exits the centrifugal separator and enters the hopper.

From the foregoing, as the auxiliary engine operates to drive the turbine (not shown) associated with the centrifugal separator 23, the generally continuous closed air flow path for picking up debris from an associated road or like surface S is established and is generally defined by air exiting the axial air outlet 56 (FIG. 1) of the centrifugal separator 23, entering the fitting 55, flowing through the tube 54 into the inlet opening 53 of the pick-up head 24, traveling along the pick-up head 24 to entrain debris therewith, the air-entrained debris exiting the pick-up head 24 through the outlet opening 52, flowing upwardly through the tube 51 (FIGS. 9 and 13), entering the hopper opening 41, flowing upwardly through the hopper inlet tube 42 (FIGS. 9 and 13), and exiting the opening 43 thereof with its direction being influenced by the flexible deflector 47, as indicated by the unnumbered headed arrows in FIG. 13. Heavier debris D falls and lighter debris and air-entrained dust exits the rectangular screen 28 and hopper opening 37 and enters the inlet opening 30 of the centrifugal separator housing 22. Cleaner air then exits the axial air outlet 56 of the centrifugal separator 23 to complete the closed continuous flow path. Lighter dust and dirt D' (FIG. 13) are centrifugally separated in the centrifugal separator 23 and exit therefrom through the dust discharge opening 31 which directs the dust into a skimmer chamber 48 of the hopper 35 which has a hinged door 49 which automatically pivots open during hopper dumping to discharge the dust therefrom.

The sweeper 10 may, of course, include gutter brooms at either or both sides in the manner disclosed in U.S. Pat. No. 3,790,981 to direct debris which is laterally outboard of the pick-up head 24 adjacent curbs or gutters toward the pick-up head 24 for eventual deposit into the hopper 35.

Figure 6:
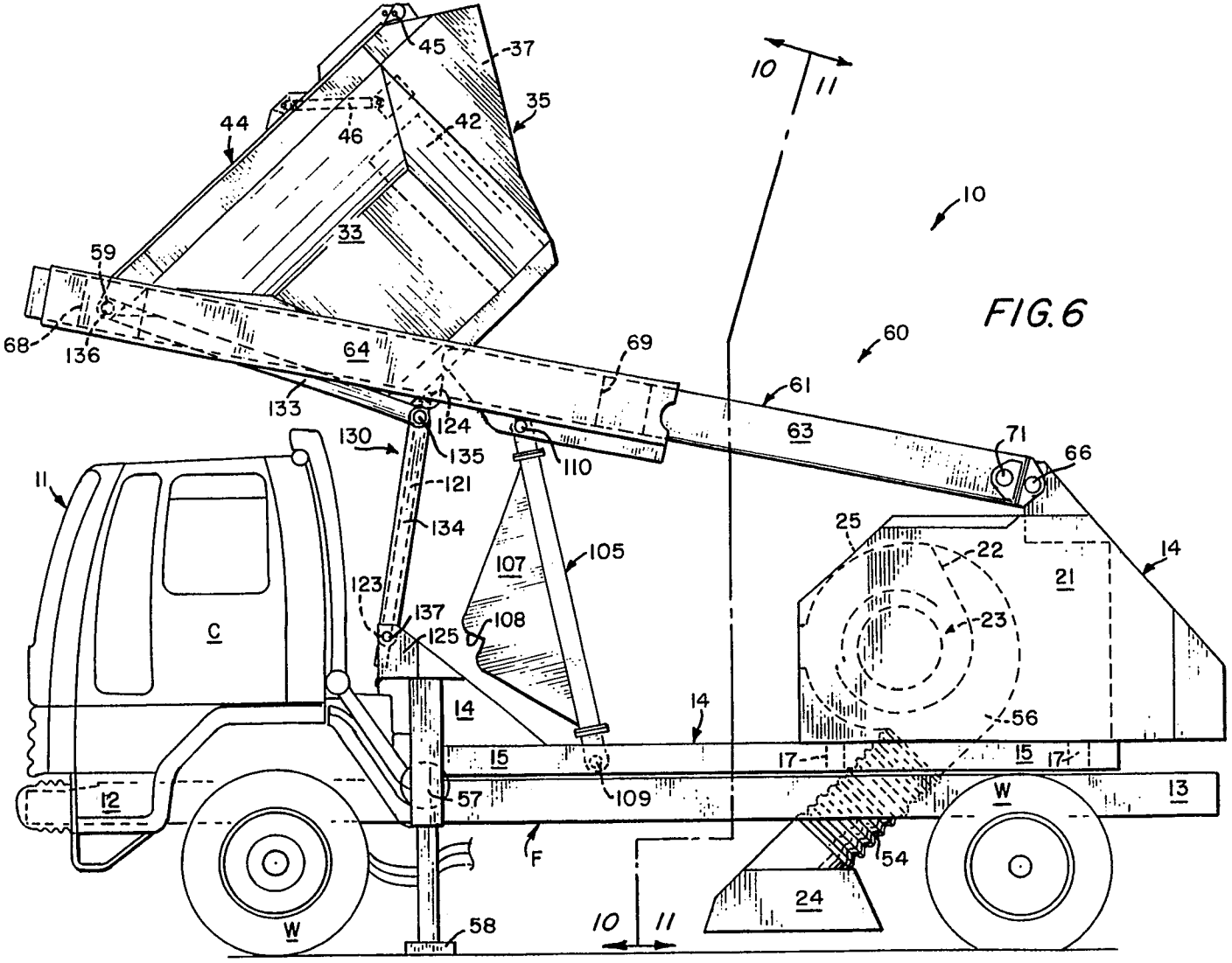
Figure 7:
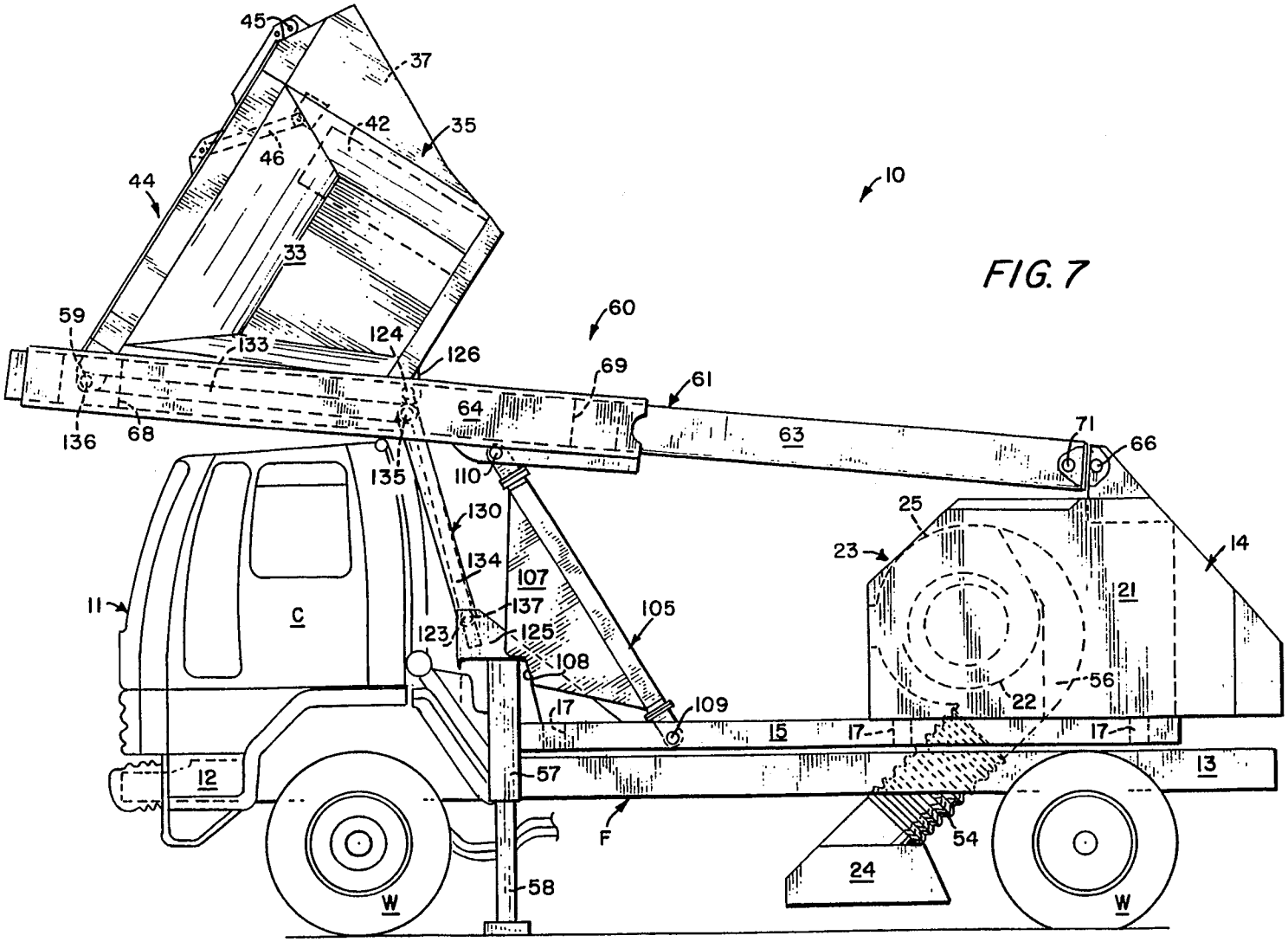
Figure 8:
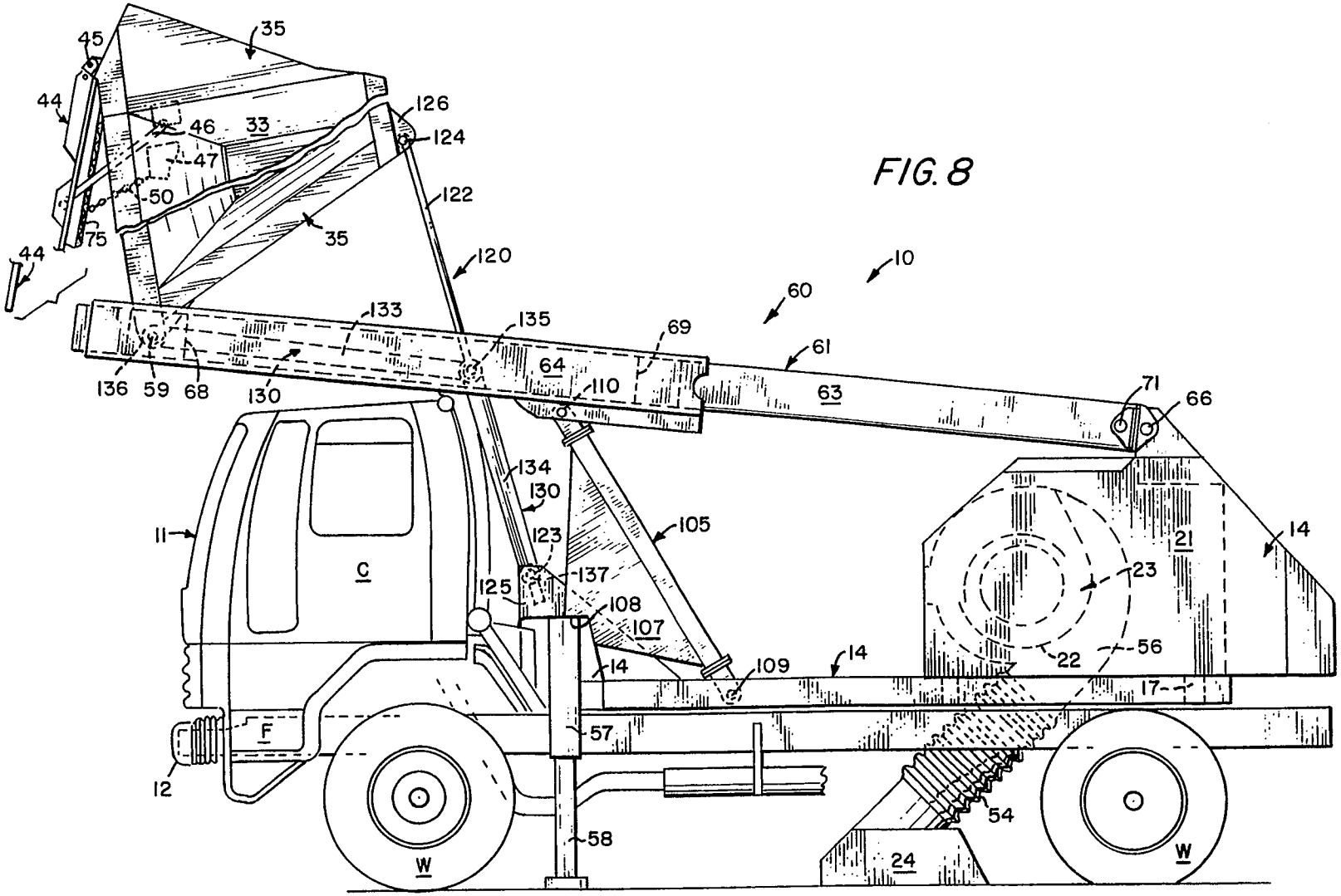
FIG. 8 is a schematic side elevational view of the over-the-cab or high dump street sweeper, and illustrates the hopper in its final dumping position with the hopper dumping cylinder extended just after the opening of the hopper dumping door to discharge debris from the hopper.

A lateral stabilizer 57 in the form of a fluid cylinder carrying a foot 58 is carried by the frame F behind the cab C at each side of the vehicle 11. The feet 58 of the stabilizer 57 are above the surface or ground S during travel of the sweeper 10 but are extended downwardly into contact with the ground or surface S to support the frame F without overloading the suspension system (not shown) of the vehicle 11 when the hopper 35 is being dumped and/or moved toward its dumping position, as will be described more fully hereinafter (FIGS. 2 through 8). Preferably, the feet 58 are brought into contact with the ground or surface S prior to initiating movement of the hopper 35 from its nondumping or travel position (FIG. 1) toward its dumping position (FIG. 8).

The hopper 35 is moved continuously from the position illustrated in FIG. 1 to the position illustrated in FIG. 8 through sequential positions illustrated in the Figures therebetween by hopper moving means or a hopper moving mechanism which is generally designated by the reference numeral 60. The hopper moving means 60 moves the hopper 35 from its first, nondumping travel position (FIG. 1) to its over-the-cab predumping position (FIG. 7) and subsequently to its dumping position (FIG. 8) along a compound path of travel from the rear end 13 of the frame F to front end 12 which includes a generally longitudinal path of travel combined with a generally arcuate path of travel. This direction of movement is reversed when the hopper moving means 60 moves the hopper 35 from the dumping position (FIG. 8) back to its nondumping or travel position (FIG. 1).

Figure 9:
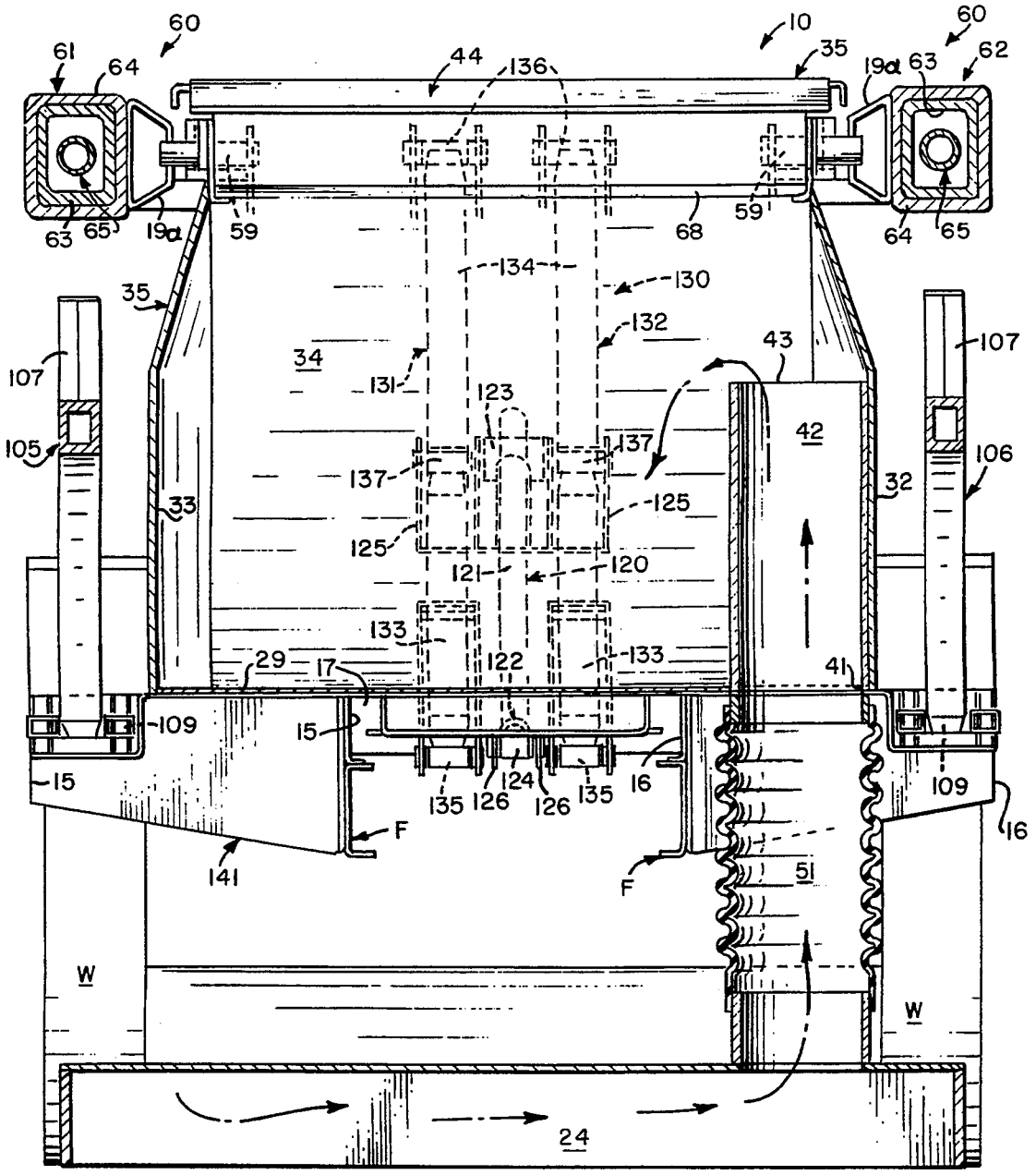
FIG. 9 is a cross-sectional view taken generally along line 9—9 of FIG. 1, and illustrates the two control arms, the two pairs of extendable and retractable telescopic members, the pairs of links of the occupant-protection system, and the hopper dumping cylinder.
Figure 10:
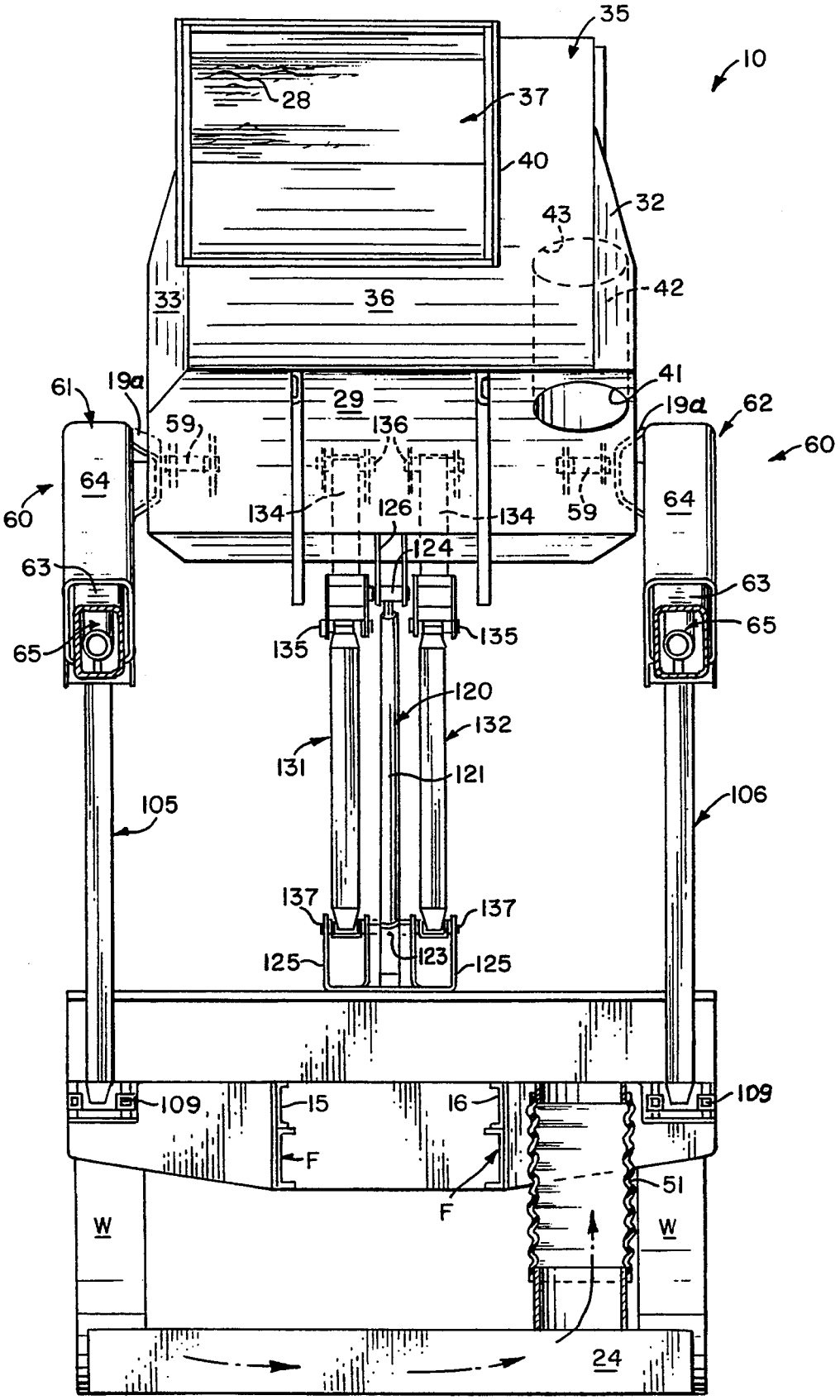
FIG. 10 is a cross-sectional view taken generally along line 10—10 of FIG. 6, and illustrates much of the details of FIG. 9 with the hopper one figure in the sequence removed from its over-the-cab or pre-dumping position, and particularly illustrates a circular inlet opening in a bottom wall of the hopper and a rectangular outlet opening in a rear wall of the hopper.
Figure 11:
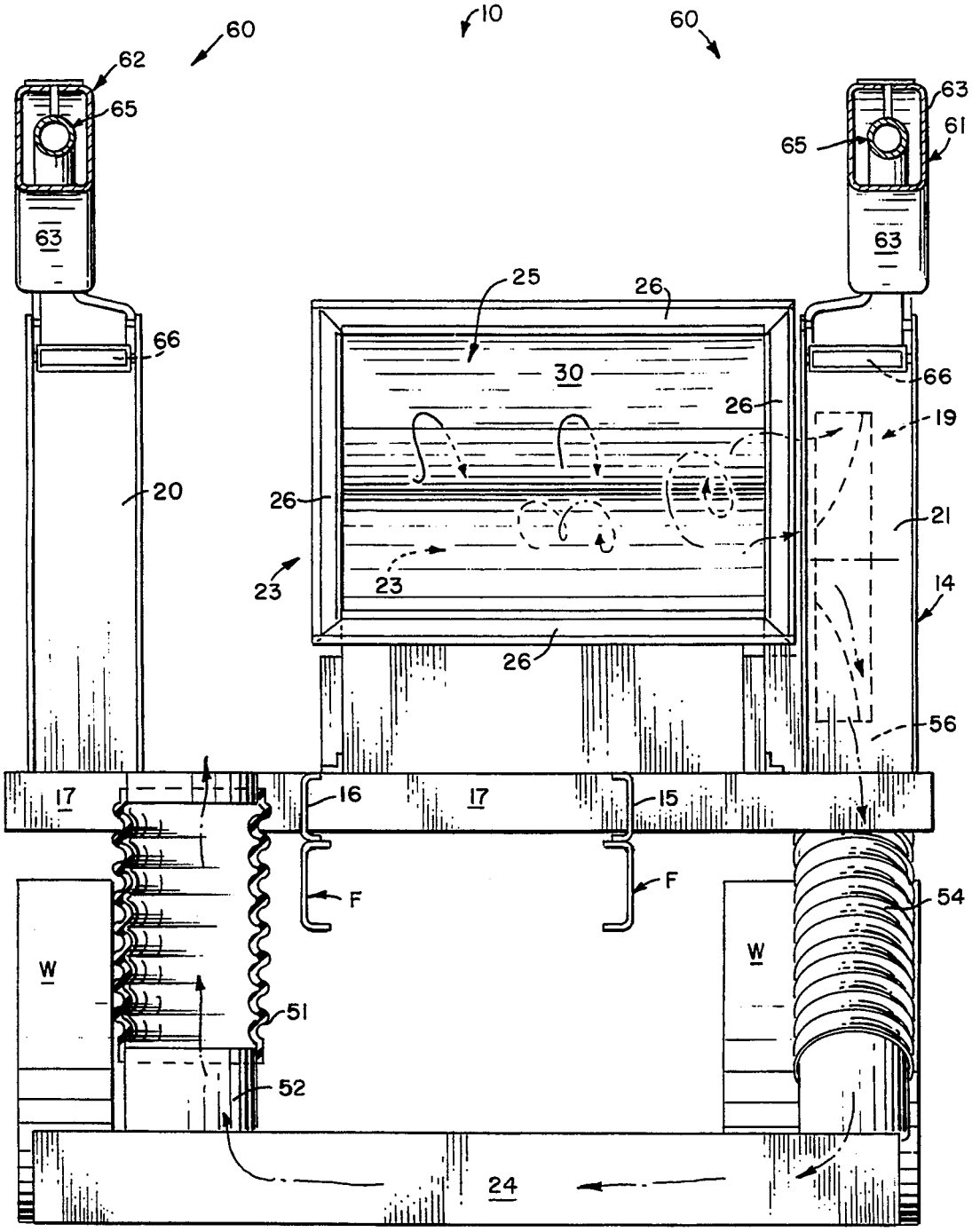
FIG. 11 is a cross-sectional view taken generally along line 11—11 of FIG. 6, and illustrates side walls of the frame, the centrifugal separator therebetween, and a rectangular opening of the centrifugal separator which matches the rectangular opening of the hopper.

The hopper moving means or mechanism 60 includes first and second pairs of extendable and retractable members or sliders 61, 62 (FIGS. 1 through 12), each of which includes inner and outer telescopic members 63, 64, respectively, each of which is generally of a box-like or square cross-sectional configurations (FIGS. 9 and 10). The outer members 64 of each of the pairs of extendable and retractable pairs 61, 62 are transversely connected by beams or members 68, 69. The hopper 35 is connected by transversely aligned pivots 59 (FIG. 9) to brackets **19*a* welded to the beam 68 and to the outer members 63, 64**.

Figure 12:
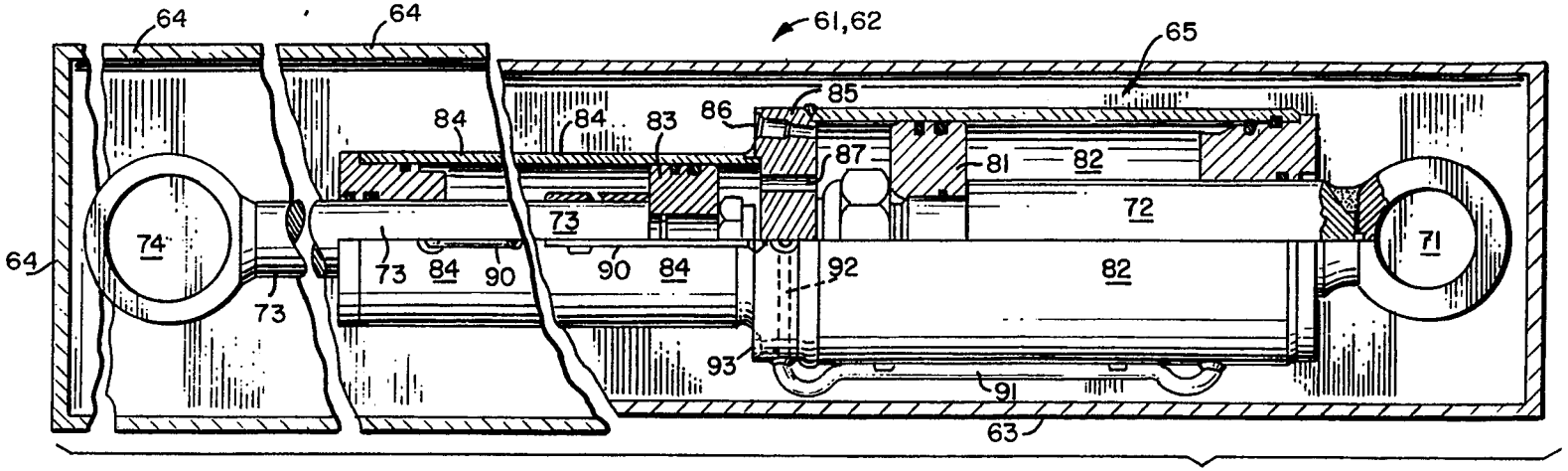
FIG. 12 is a cross-sectional view taken generally along line 12—12 of FIG. 1, and illustrates a double acting piston for operating the extendable and retractable members.

Means for selectively extending and retracting each of the members 63, 64 relative to each other is through a hydraulic piston/cylinder mechanism 65 (FIG. 12) which is part of a hydraulic circuit 70 (FIG. 14) which will be described more fully hereinafter. Each inner member 63 is articulately or pivotally connected by pivot means 66 to the associated upstanding side walls 20, 21 (FIG. 11) of the sweeper frame 14. A pivot 71 (FIG. 12) pivotally connects a rod 72 of each hydraulic piston/cylinder mechanism 65 to its associated inner member 63 adjacent the pivot 66 while another rod 73 of each hydraulic piston/cylinder mechanism 65 is connected by a pivot 74 to the outer member 64. As is best illustrated in FIG. 12, the rod 72 is relatively short and is connected to a large diameter (6 inch) piston 81 housed in a cylinder 82 while the rod 73 is relatively long and is connected to a small (4 inch) piston 83 housed in a cylinder 84. A divider plate 85 separates the cylinders 82, 84 and includes a high pressure inlet port 86 and a bore 87 which places the head ends of the cylinders 82, 84 in constant fluid communication with each other. Pipes 90, 91 open into the cylinders 84, 82, respectively, at the rod ends, are in fluid communication with each other by a bore 92 in the divider plate 45, and a port 93 in fluid communication with the bore 92 is in fluid communication with a reservoir 95 (FIG. 14) of the hydraulic circuit 70. Obviously, when each of the hydraulic piston/cylinder mechanisms or dump cylinders 61, 62 are completely retracted, as in FIG. 12, the extendable and retractable members 63, 64 are also fully retracted (FIG. 1), while the converse is also true (FIGS. 7 and 8). Under certain circumstances the double-rod cylinders 65 can instead each be only a single-rod cylinder.

Control arms 105, 106 are rigid members, and each includes a generally triangular metallic plate 107 having a relatively square cut-out or notch 108. Pivots 109 are in transverse alignment with each other and pivotally connect the control arms 105, 106 to the respective side frame members 15, 16 (FIG. 9) of the sweeper frame 14. Transversely aligned pivots 110 articulately connect the control arms 105, 106 to the outer member 64 of the respective pairs of extendable and retractable members 61, 62 (FIG. 1).

Figure 14:
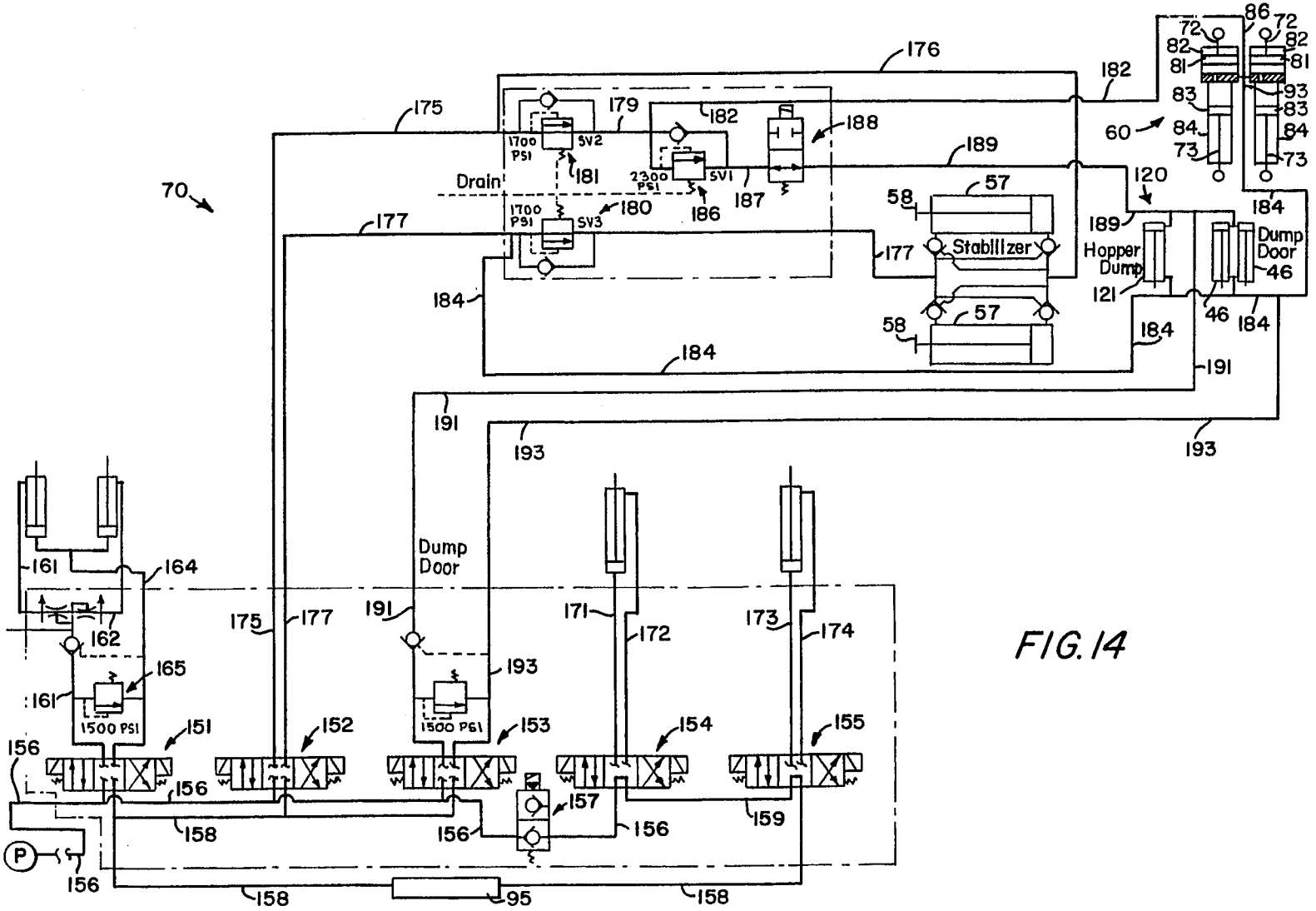
FIG. 14 is a schematic view of a hydraulic circuit, and illustrates various fluid cylinders and valves for effecting the movement of the hopper between the positions shown in FIGS. 1 through 8 and the reversal thereof.

Another hydraulic piston/cylinder mechanism or hopper dump cylinder 120 (FIGS. 1, 8 and 10) is formed by a hydraulic cylinder 121 and a piston rod 122 which are respectively connected by pivots 125, 124 to respective brackets 125, 126 of the frame 14 and hopper 35. The hopper tilting or dump cylinder 120 is located on a longitudinal center line of the vehicle 11, and inlet and exhaust ports thereof (not shown) are appropriately connected to the hydraulic circuit 70 (FIG. 14). At any time between the position shown in FIGS. 1 through 7, the rod 122 of the hopper tilting cylinder 121 of the hopper tilting mechanism 120 is fully retracted, and in this position the hopper tilting mechanism 120 guides the hopper 35 over the cab C in the absence of contact therewith (See FIGS. 1 through 8). It is only after reaching the predumped or over-the-cab position in FIG. 7 that the rod 122 is extended to the position shown in FIG. 8 to tilt the hopper 35 about the pivots 59 incident to the dumping of debris D from the hopper interior upon the opening of the hopper door 44, as will be described more fully hereinafter.

The sweeper 10 also includes an occupant protection system or mechanism 130 (FIGS. 1 through 10) which protects an occupant in the cab C at all times during the operation of the hopper moving means or dumping mechanism 60, but particularly when the hopper 35 is near and in its predump position (FIG. 7) and its dumping position (FIG. 8). Unless otherwise provided for, it will be readily apparent from FIG. 8 that should the hopper tilting or dumping mechanism 120 fail, the hopper 35 would pivot clockwise, as viewed in FIG. 8, about the pivots 59 and crash into the cab C damaging the same and causing injury to occupants therein. The vehicle occupant protection mechanism 130 prevents the latter from occuring through two pairs of protection members or links 131, 132 (FIGS. 7, 8, 9 and 10) immediately adjacent and straddling the hopper tilting mechanism 120. Each pair of occupant protection links 131, 132 includes an upper link or member 133 and a lower link or member 134. The links or members 133, 134 of each of the pairs 131, 132 are pivotally connected to each other by a pivot pin 135. The upper links or members 133 are pivotally connected by a pivot pin 136 to appropriate brackets (unnumbered in FIGS. 9 and 10) projecting from the transverse beam 68 spanning and connected between the outer extendable and retractable members 64. Pivot pins 137 connect the lower ends of the lower links or members 134 to the sweeper frame 14. The upper links 133 and lower links 134 are generally compactly folded relative to each other and are disposed between the cab C and the hopper 35 when the hopper 35 is in its nondumping or travel position (FIG. 1). However, as the hopper 35 is moved toward its final dumping position (FIG. 8), the upper and lower links 133, 134 at each side of the hopper tilting mechanism 120 simultaneously unfold as pivoting occurs about the pivot pins 135, 136 and 137, as is progressively illustrated in FIGS. 2 through 6. In FIG. 6, the upper links 133 generally underly the front wall 34 of the hopper 35 and occupy a position between the hopper 35 and the cab C. The final position of the occupant protection mechanism 130 is shown in FIG. 7 in which the upper links 133 underly the hopper 35 and prevent the hopper 35 from descending downwardly into and/or against the cab C and any occupants therein. The upper links 133 remain in the position shown in FIG. 7 as the hopper 35 is tilted (FIG. 8) and, as earlier noted, should the tilting mechanism 120 fail and the hopper 35 swing clockwise about the pivots 59, as viewed in FIG. 8, the hopper 35 would strike the upper links or members 133 and further descent to, toward and against the cab C would be precluded thereby protecting the cab and the occupants therein.

Before describing the overall operation of the sweeper 10, reference is made to FIG. 14 and the details of the hydraulic circuit 70. The hydraulic circuit 70 includes three valves 151 through 153 connected in parallel and two valves 154, 155 connected in series with these two sets of valves being connected to a high pressure fluid (oil) line 156 which includes an inline solenoid operated two-way valve 157. A pump P operated by the auxiliary engine (not shown) pressurizes the fluid in the high pressure line 156, and a return, exhaust or low pressure line 158 and its several branch lines returns the fluid to the reservoir 95. The valves 151 through 155 are illustrated being held in their neutral position by associated springs, and in this position flow is blocked to the associated hydraulic equipment. The valve 151 controls the up-and-down motion of the pick-up head 24; and the valves 154, 155 control the operation of the left and right gutter brooms, respectively, as is more fully detailed in the earlier mentioned Young patents; the valve 153 controls the operation of the dump door 44 and the valve 152 controls the operation of the stabilizers 57, the hopper tilt mechanism 120 and the hopper moving mechanism 60.

When the valve 151 is moved to the right, high pressure from the line 156 passes through the valve 151, a line 161 and is divided by appropriate flow regulators (unnumbered) before entering the rod ends of a pair of pick-up head cylinders (unnumbered) through conduits 161, 162 resulting in the pick-up head 24 being moved upward relative to surface S. A line 164 connected to the cylinder ends of both of the pick-up head cylinders connects the low pressure or cylinder side of the pick-up head cylinders to the line 158 through the valve 151 to deliver exhaust fluid through the valve 151 to the reservoir 95. At 1,500 psi a valve 165 relieves pressure by recirculating the high pressure fluid directly from the line 161 into the line 164 and through the valve 151 and line 158 and back to the reservoir 95. The pick-up head 24 is moved downwardly toward the surface S by shifting the valve 151 completely to its left position at which time high pressure fluid from the line 156 passes through the valve 151 into the line 164 into the cylinder ends of the pick-up cylinders extending the pistons and lowering the pick-up head 24. The pick-up cylinders are exhausted to the reservoir 95 over the lines 161, 162, the valve 151 and the line 158.

The left-hand and right-hand gutter brooms (not shown) can be serially operated by moving either of the respective valves 154, 155 to the right. When the valve 154 is moved to the right, high pressure fluid flows through the high pressure line 156 and the valve 157 therein through the valve 154 and a line 171 into the cylinder end of the left gutter broom cylinder per the appropriate Young patents heretofore noted. Low pressure fluid exhausts from the rod end of the cylinder through a line 172, the valve 154 and a line 159 connected to the valve 155 which in its neutral position (shown) delivers the low pressure fluid to the reservoir 95 via the line 158 exiting the valve 155. Movement of the valve 154 to the left directs high pressure fluid into the rod end of the left-hand gutter broom cylinder via the line 172 with the return to the reservoir 95 from the cylinder end being through the line 171, the valve 154, the line 159, the valve 155 and the line 158.

With the valve 154 in the neutral position illustrated, the right-hand gutter broom (not shown) is extended by moving the valve 155 to the right which will deliver high pressure fluid through the line 156, the valve 157, the valve 154, the line 159 and through a line 173 into the cylinder end of the gutter broom cylinder. Low pressure return fluid is delivered through a line 174, the valve 155 and the line 158 to the reservoir 95.

The hopper 35 movement sequence from its non-dumping or travel position (FIG. 1) to its pre-dumping position (FIG. 7) is initiated by moving the valve 152 to the right which conducts high pressure fluid from the line 156 through the valve 152, a line 175 and a line 176 to the cylinder ends of the stabilizers or stabilizer cylinders 57 resulting in the rods thereof moving outwardly of the cylinders and completely bottoming therein thereby bringing the feet 58 into contact with the ground S at a predetermined repeditive extended distance. The rod side of each of the cylinders 57 is exhausted by a low pressure return line 177 through the return side (shown) of a valve 180, and the valve 152 to the reservoir 95 via the line 158. When the pressure in the stabilizer cylinders 57 reaches 1700 psi, the valve 181 shifts high pressure fluid flows from the line 175 through the valve 181, a line 179, and a line 182 into the inlet port 86 (FIG. 12) of the cylinders 82, 84 of the hopper moving mechanism 60 which through the outward motion of the rods 72, 73 progressively moves the outer members or sliders 64 in the direction of the cab C under the control of the control arms 105, 106. This same movement of the sliders 64 also pivots the hopper dump cylinder 120 about the pivot 123 to guide the hopper 35 between the FIGS. 1 through 7 positions thereby guiding the hopper 35 over the cab C. The exhaust port 93 of the cylinders 82, 84 is connected over by a line 184 to the low pressure return line 177.

Eventually the rods 72, 73 are fully extended (FIG. 7), pressure builds-up in the cylinders 82, 84, and at 2300 psi a valve 186 shifts from the position illustrated with the result that high pressure fluid from the line 179 flows through the valve 186, a line 187, a normally open valve 188 and a line 189 to the inlets of the dump door cylinders 46 and the hopper tilt or hopper dump cylinder 121. Since the hopper 35 is relatively heavy, particularly when filled to capacity with debris D, the pressure in line 189 will first open the dump door 44 of the hopper 35 and only thereafter begin tilting the hopper 35 through the hopper dumping mechanism 120 until the debris D has been dumped. The low pressure or return side of the cylinders 46, 121 are connected to the line 184 which in turn is connected to the low pressure return line 177. Obviously, at the conclusion of the dump cycle, the valve 152 is moved to the left and the operation just described is essentially repeated in the reverse sequence to first close the dump door 44 of the hopper 35, return the hopper 35 to its nontilted position (FIG. 7), and fully retract the rods 72, 73 into their respective cylinders 82, 84 (FIG. 1) when the pressure in the cylinders 82, 84 reaches 1700 psi at full retraction, the valve 180 shifts, high pressure fluid flows from line 177 through the valve 180 therein and into the rod end of the stabilizer cylinders 57 to retract the stabilizer feet 58 thereof.

The valve 153 of the hydraulic circuit 70 is for opening or closing of the dump door 44 of the hopper 35 for inspection or cleaning purposes without cycling the mechanism 60 in either direction by operating the valve 152 as just described. In this case the valve 152 remains in the position shown in FIG. 14, the valve 188 is moved to its blocked position, and the valve 153 is moved to the right conducting high pressure fluid from the line 156 through the valve 153 and through a line 191 into the inlets of the dump door cylinders 46 and the hopper tilt cylinder 121. The line 191 also connects to the line 189, but the latter is now blocked by the valve 188. Because of the heavy weight of the hopper 35, as compared to the dump door 44, only the dump door cylinders 46 will be operative with the exhaust side of the dump door cylinders 46 being returned to the reservoir 95 via the line 184, a line 193, the valve 153, and the line 158. Shifting the valve 153 to the left and closing valve 188 reverses the cycle to close the hopper dump door 44 via the reverse flow of high pressure fluid into the rod end of the cylinders 46 via the line 193 and line 184 and the return of exhaust liquid through the line 191 to the reservoir 95.

OPERATION

The operation of the sweeper 10 includes the performance of an appropriate sweeping operation during which either of the gutter brooms are extended and the pick-up head 24 is adjacent the surface S. As the vehicle 11 is driven forwardly, the rotating brush of the gutter broom directs debris toward the pick-up head 24 and high pressure air flow, as heretofore described, continuously generally recirculates this air and the entrained debris D to, into and through the hopper 35 and the centrifugal separator 23 (FIG. 13). After the hopper 35 is filled with debris, the pick-up head 24 is retracted upwardly, as is either of the gutter brooms, and the sweeper 10 is then driven to an appropriate dump site. The vehicle 11 is, of course, driven forwardly directly to the dump site and when appropriately positioned, the valve 152 of the hydraulic circuit 70 (FIG. 14) is moved to the right to set in operation the cycle sequence heretofore described beginning with the stabilizers 57 bringing the feet 58 thereof against the surface S to prevent the weight of the hopper 35 and its contents, as it moves over the cab C, from placing excessive forces upon the front end suspension system of the vehicle 11.

After pressure reaches 1700 psi in the stabilizers 57, the high pressure fluid is introduced into the inlet port 86 (FIGS. 12 and 14) of the hopper moving mechanism 60 resulting in the initial movement of the rod 72 due to the larger diameter of the piston 81 as compared to the smaller diameter of the piston 83. Eventually, however, both rods 72, 73 are fully extended and during this progressive extension, the members or sliders 64 are progressively and continuously extended to the left relative to the members 63 through the sequence illustrated in FIGS. 2 through 7 of the drawings. At this time the rigid control arms 105, 106 and the hopper dump mechanism 120 are also pivoted counterclockwise from their "home" positions shown in FIG. 1 to the final position of FIG. 7. The operation of the control arms 105, 106 effectively translates the purely linear relative motion of the member 63, 64 into compound motion by imparting an arcuate component thereto, as defined by the length of the control arms 105, 106 between the pivots 109, 110 thereof. As earlier noted, the hopper dump mechanism 120 simultaneously guides the hopper 35 over the cab C. During this motion, the control arms 105, 106 reach a position shown in FIG. 5 which is almost vertical, and at this point the left-hand ends of the members 64 are essentially at their maximum vertical height above the surface S to provide ample clearance for the hopper 35 during the continued forward motion of the hopper 35 to its over-the-cab position (FIGS. 7 and 8). From slightly past the position shown in FIG. 5, the control arms 105, 106 begin lowering the forward ends of the members 64 downwardly (compare FIGS. 5, 6 and 7) until such time as the members 63, 64 are relatively fully extended (FIG. 7) and the hopper 35 is in its over-the-cab predump position. The entire motion of the mechanism 60 between FIGS. 1 and 7 is effected only under the pressurization of the cylinders 82, 84 and the attendant outward telescopic motion of the members 64 relative to the members 63. Furthermore, the initial position (FIG. 1) of the members 63, 64 and the control members 105, 106, including the triangulation defined by the pivots 109, 110 and 66, assures that the hopper 35 and the centrifugal separator 23 part or separate smoothly across the plane Ps, and also return in sealing engagement at the plane Ps. This same movement also "unfolds" the occupant protecting mechanism 130 through the progressive motion illustrated sequentially in FIGS. 1 through 7 until the links 133 of both pairs of occupant-protective links 131, 132 underlie the hopper 35 and prevent the hopper 35 from descending downwardly into the cab C or any occupants therein.

At the end of the maximum extension of the members 64 and the acquired 2300 psi pressure in the associated cylinders 82, 84 (FIG. 12), the notches 108 of the control arms 105, 106 are contiguous the upper ends of the stabilizers 57 (FIG. 7). Should the hydraulic circuit 70 fail, the entire mechanism 60, the hopper 35 and its load would be solely mechanically supported thereby avoiding what might otherwise be catastrophic damage to the vehicle/its components. At the same time, the dump door cylinders 46 operate resulting in the opening of the hopper door 44 and the pulling of the link 50 (FIG. 8) resulting in the shaking or flexing of the deflector 47 and the self-cleaning thereof.

Next in the sequence of operation is the extension of the rod 122 from the cylinder 121 of the hopper dumping mechanism 120 causing the hopper 35 to pivot about the pivots 59 and the debris D being dumped over-the-cab C into the designated dump area. The latter is, of course, effected without endangering the sweeper 10, the occupants of the cab C, outsiders or outside property incident to backing the vehicle to the dump site which, of course, is unnecessary in accordance with the present invention.

Obviously, the reverse sequence of operation of the hydraulic circuit 70 heretofore described results in the sequential operation of the various components and the return of the hopper 35 from the position shown in FIG. 8 to the position shown in FIG. 1.

Although a preferred embodiment of the invention has been specifically illustrated and described herein, it is to be understood that minor variations may be made in the apparatus without departing from the spirit and scope of the invention, as defined in the appended claims.

We claim:

1. A hopper particularly adapted to receive air-entrained material comprising a receptacle having an inlet and a first outlet through which air-entrained material is adapted to enter said hopper and exit said hopper respectively, a centrifugal separator housing having an inlet in fluid communication with said first outlet, said centrifugal separator housing including means for centrifugally separating material from air-entrained material, said hopper having a second outlet through which material accumulated in said hopper can be dumped, a door normally closing said second outlet; a screen interiorly of, spaced from and carried by said door; said screen and door defining an air flow chamber through which air can flow during movement of the air between said receptacle inlet and first outlet whereby material can accumulate within said chamber and/or adhere to the underside of said screen, means for defining an opening into said chamber by way of which accumulated and/or adhered material can be removed from said chamber and/or screen, and means for creating a flow of air along a path through said screen and into said centrifugal separator housing.

2. The hopper as defined in claim 1 including means for opening said door to open said second outlet whereby material can be discharged therethrough, a deflector contiguous said receptacle inlet for deflecting material exiting said receptacle inlet into said receptacle, and means for moving said deflector by and in response to the opening movement of said door to dislodge material adhering to said deflector.

3. The hopper as defined in claim 1 wherein said means for defining an opening into said chamber is carried by said door.

4. The hopper as defined in claim 1 wherein said door includes opposite ends, means pivoting a first of said door ends to said receptacle, and a second of said door ends includes said means for defining an opening into said chamber.

5. The hopper as defined in claim 3 wherein said door includes opposite ends, means pivoting a first of said door ends to said receptacle, and a second of said door ends includes said means for defining an opening into said chamber.

6. The hopper as defined in claim 2 wherein said deflector is made of flexible material.

7. The hopper as defined in claim 2 wherein said deflector moving means is a member connected between said deflector and said dump door.

* * * * *